US006767279B1

(12) United States Patent
Serrano

(10) Patent No.: US 6,767,279 B1
(45) Date of Patent: Jul. 27, 2004

(54) CEILING VENT ASSEMBLY

(76) Inventor: Rene' Serrano, 1418 Rule Rd., North Tonawanda, NY (US) 14120

( * ) Notice: Subject to any disclaimer, the term of this patent is extended or adjusted under 35 U.S.C. 154(b) by 0 days.

(21) Appl. No.: 10/423,438

(22) Filed: Apr. 28, 2003

(51) Int. Cl.[7] ..... F24F 7/10
(52) U.S. Cl. ..... 454/299; 454/270
(58) Field of Search ..... 454/259, 284, 454/289, 292, 299, 370; 52/198, 199, 202, 200, 203

(56) References Cited

U.S. PATENT DOCUMENTS 3,934,383 A 1/1976 Perry et al.
4,389,827 A * 6/1983 Van Valkenburg ..... 52/511
4,483,102 A * 11/1984 Edwards ..... 49/465
4,520,715 A 6/1985 Coomes et al.
4,735,132 A * 4/1988 Ching ..... 454/358
4,760,773 A 8/1988 Pezzulli
5,720,660 A * 2/1998 Benedetto et al. ..... 454/284
5,815,996 A 10/1998 Granger
6,014,841 A 1/2000 McCoy, Jr. et al.
6,050,893 A 4/2000 Waite
6,257,976 B1 7/2001 Richardson, III
6,461,235 B2 * 10/2002 Rutler et al. ..... 454/289
6,575,827 B1 * 6/2003 Rutler et al. ..... 454/289

* cited by examiner

*Primary Examiner*—Gregory Wilson

(57) ABSTRACT

A ceiling vent assembly for providing a cover for bathroom exhausts fans. The ceiling vent assembly includes a ceiling vent assembly and a vent cover assembly which includes a support frame being securely and conventionally attached to the ceiling and being disposed about the vent; and also includes a cover frame being hingedly and securely attached with hinges to the support frame; and further includes a sheet of transparent material being securely and conventionally attached to the cover frame and being closeable over the vent; and also includes fasteners for removably attaching the cover frame to the support frame and closing the sheet of transparent material over the vent; and a handle assembly for opening and closing the sheet of material over the vent.

5 Claims, 3 Drawing Sheets

CEILING VENT ASSEMBLY

BACKGROUND OF THE INVENTION

1. Field of the Invention

The present invention relates to vents and more particularly pertains to a new ceiling vent assembly for providing a cover for bathroom exhaust fans.

2. Description of the Prior Art

The use of vents is known in the prior art. More specifically, vents heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,815,996; U.S. Pat. No. 6,257,976; U.S. Pat. No. 4,760,773; U.S. Pat. No. 3,934,383; U.S. Pat. No. 6,050,893; U.S. Pat. No. 4,520,715; and U.S. Pat. No. 6,014,841.

While these devices fulfill their respective, particular objectives and requirements, the aforementioned patents do not disclose a new ceiling vent assembly. The prior art includes insulated ventilator covers.

SUMMARY OF THE INVENTION

The general purpose of the present invention, which will be described subsequently in greater detail, is to provide a new ceiling vent assembly which has many of the advantages of the vents mentioned heretofore and many-novel features that result in a new ceiling vent assembly which is not anticipated, rendered obvious, suggested, or even implied by any of the prior art vents, either alone or in any combination thereof. The present invention includes a ceiling vent assembly and a vent cover assembly which includes a support frame being securely and conventionally attached to the ceiling and being disposed about the vent; and also includes a cover frame being hingedly and securely attached with hinges to the support frame; and further includes a sheet of transparent material being securely and conventionally attached to the cover frame and being closeable over the vent; and also includes fasteners for removably attaching the cover frame to the support frame and closing the sheet of transparent material over the vent; and a handle assembly for opening and closing the sheet of material over the vent.

None of the prior art includes the combination of the elements of the present invention.

There has thus been outlined, rather broadly, the more important features of the ceiling vent assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new ceiling vent assembly which has many of the advantages of the vents mentioned heretofore and many novel features that result in a new ceiling vent assembly which is not anticipated, rendered, obvious, suggested, or even implied by any of the prior art vents, either alone or in any combination thereof.

Still another object of the present invention is to provide a new ceiling vent assembly for providing a cover for bathroom exhausts fans.

Still yet another object of the present invention is to provide a new ceiling vent assembly that provides ease of installation, adaptability and efficiency.

Even still another object of the present invention is to provide a new ceiling vent assembly that can be installed in a matter of minutes under most common makes and models of bathroom exhaust fans, and it would improve the overall energy efficiency of a structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
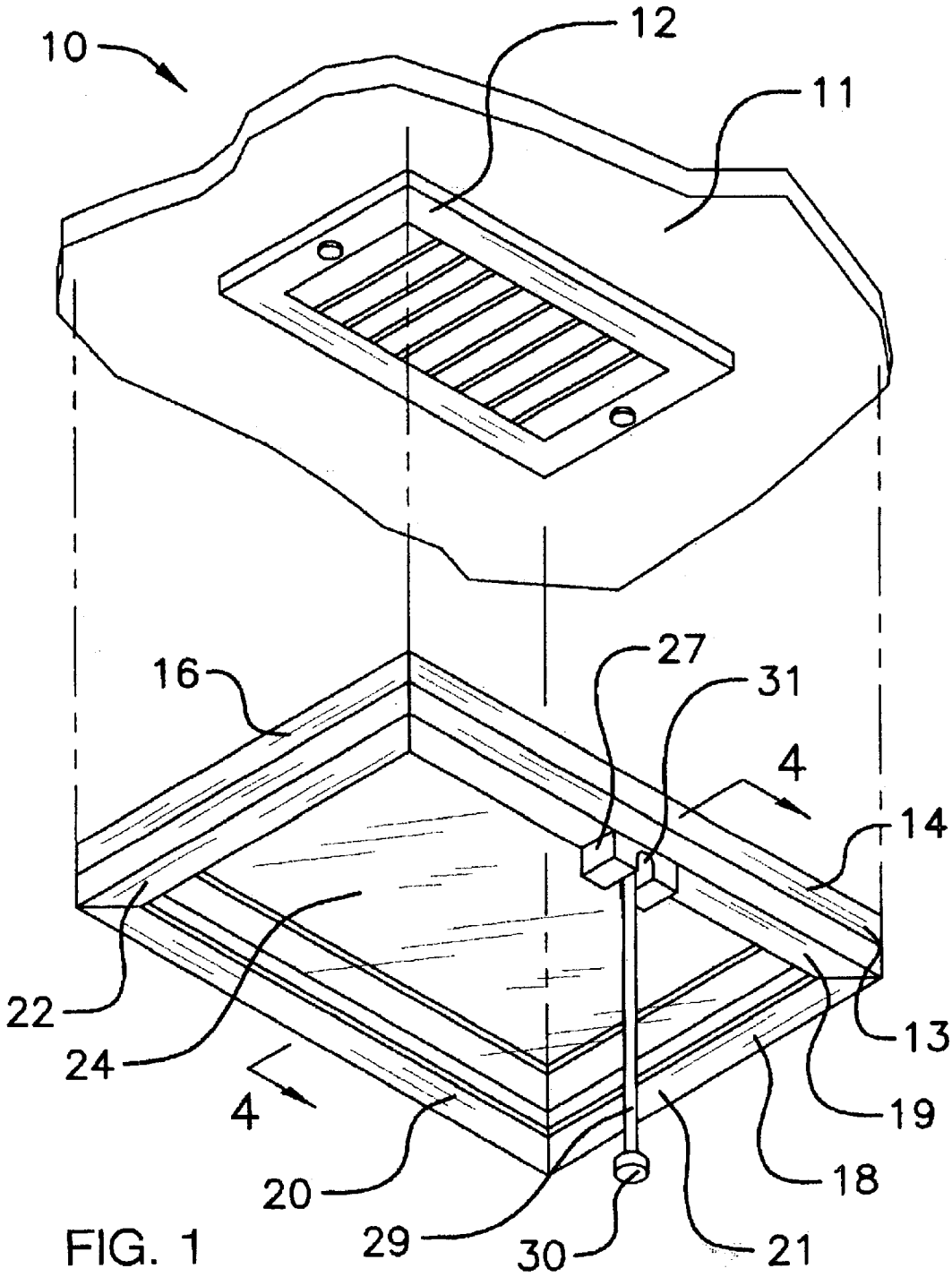
FIG. 1 is an exploded perspective view of a new ceiling vent assembly while closed according to the present invention.
Figure 2:
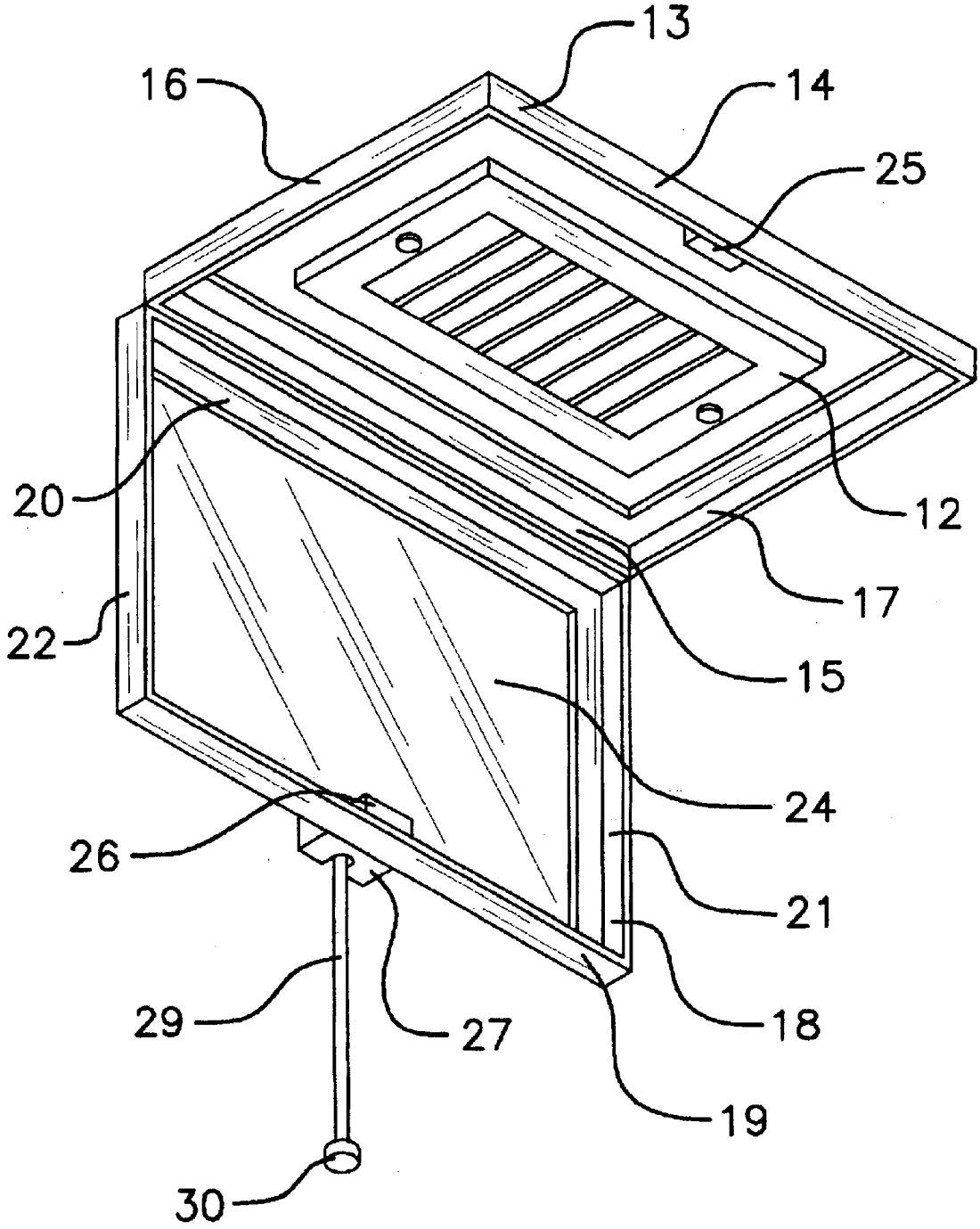
FIG. 2 is a perspective view of the present invention while open.
Figure 3:
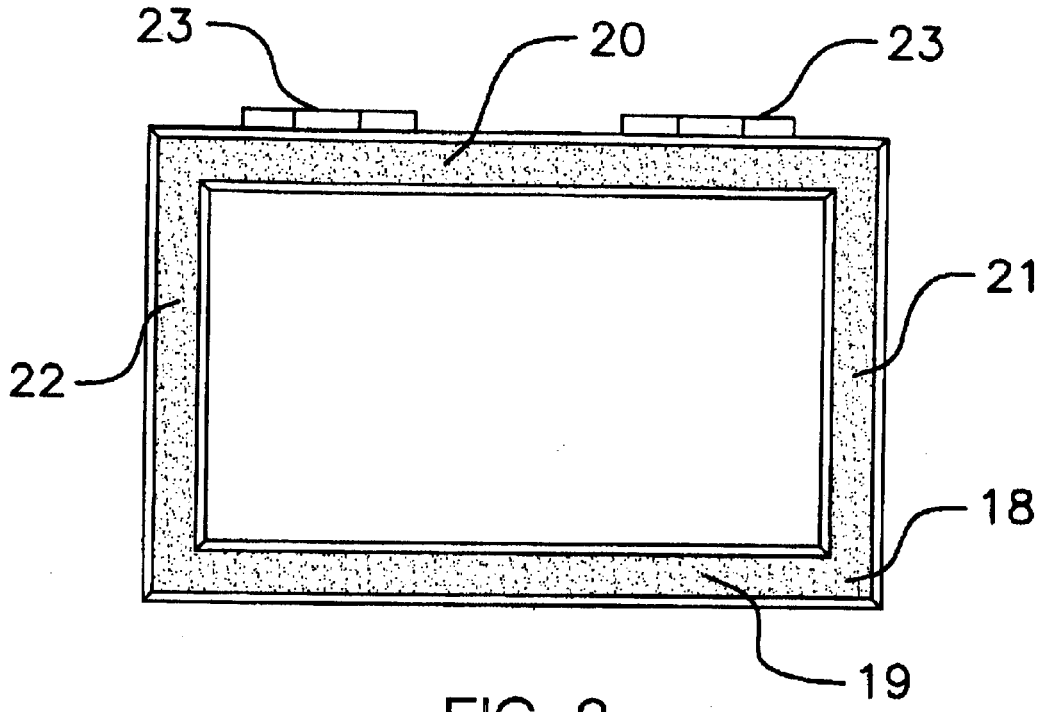
FIG. 3 is a bottom plan view of the present invention.
Figure 4:
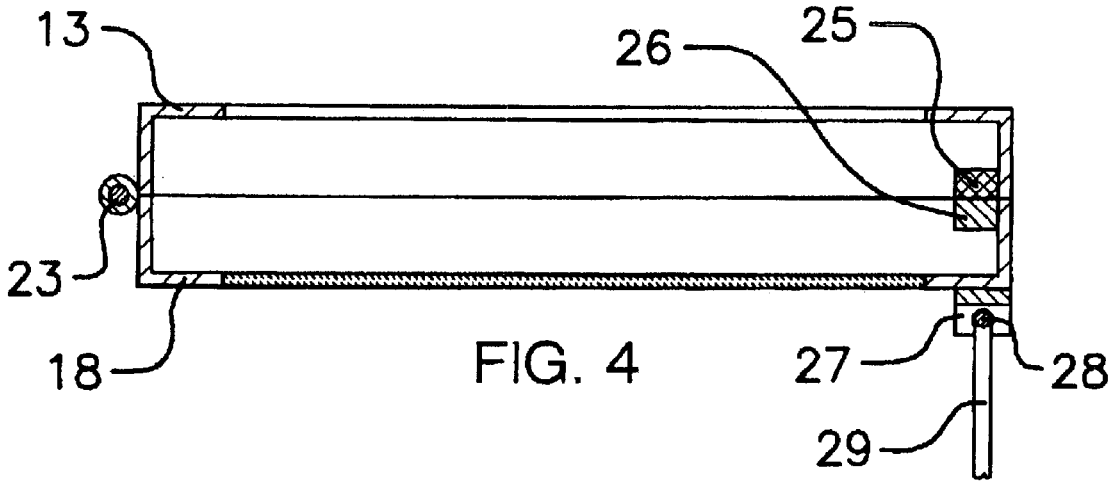
FIG. 4 is a lateral cross-sectional view of the present invention.

With reference now to the drawings, and in particular to FIGS. 1 through 4 thereof, a new ceiling vent assembly embodying the principles and concepts of the present invention and generally designated by the reference numeral 10 will be described.

As best illustrated in FIGS. 1 through 4, the ceiling vent assembly 10 generally comprises a ceiling 11, a vent 12 being disposed in the ceiling 11, and a vent cover assembly being attached to the ceiling 11 about the vent 12. The vent cover assembly includes a support frame 13 being securely and conventionally attached to the ceiling 11 and being disposed about the vent 12; and also includes a cover frame 18 being hingedly and securely attached with hinges 23 to the support frame 13; and further includes a sheet of transparent material 24 being securely and conventionally attached to the cover frame 18 and being closeable over the vent 12; and also includes fasteners 25,26 for removably attaching the cover frame 18 to the support frame 13 and closing the sheet of transparent material 24 over the vent 12; and also includes a handle assembly for opening and closing the sheet of material over the vent 12. The support frame 13 includes a pair of elongate support side members 14,15 being spaced apart, and also includes first and second elongate support end members 16,17 being conventionally attached at ends of the elongate support side members 14,15. The support frame 13 is conventionally attached to the ceiling 11 with adhesive tape. The vent 12 is disposed between the elongate support side members 14,15 and the first and second elongate support end members 16,17. The cover frame 18 includes a pair of elongate support side members 19,20 being spaced apart, and also includes first and second elongate support end members 21,22 being conventionally attached at ends of the elongate support side members 19,20 of the cover frame 18. The hinges 23 are conventionally attached to the first elongate support end members 16,21 of the support frame 13 and the cover frame 18. The sheet of transparent material 24 is securely and conventionally attached to; and disposed between the elongate support side members 19,20 and to the first and second elongate support end members 21,22 of the cover frame 18. The fasteners 25,26 include a magnet 25 being conventionally attached to the second elongate support end member 17 of the support frame 13, and also includes a piece of metal 26 being conventionally attached to the second elongate support end member 22 of the cover frame 18 and being attachable to the magnet 25 to fasten the cover frame 18 to the support frame 13 and to close the sheet of transparent material 24 over the vent 12. The handle assembly includes a swivel block 27 having a laterally-extending groove 31 being disposed in a side thereof, and also includes a spindle 28 being securely and conventionally disposed in the laterally-extending groove 31, and further includes an elongate handle member 29 having a first end which is rotatably mounted about the spindle 28, and also includes a knob 30 being conventionally attached at a second end of the elongate handle member 29.

In use, one would install the ceiling vent assembly 10 by securing the support frame 13 to the ceiling 11 with adhesive tape. Next, the user could open or close the ceiling vent assembly 10 by pulling on the knob 30 securely and conventionally attached to the elongate handle member 29 of the handle assembly. The user would close the ceiling vent assembly 10 to fulfill the need for a method of improving the energy efficiency of a bathroom equipped with a ventilation fan.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the ceiling vent assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ceiling vent assembly comprising:

a ceiling;

a vent being disposed in said ceiling; and a vent cover assembly being attached to said ceiling about said vent, said vent cover assembly including a support frame being securely attached to said ceiling and being disposed about said vent; and also including a cover frame being hingedly attached with hinges to said support frame; and further including a sheet of transparent material being attached to said cover frame and being closeable over said vent; and also including fasteners for removably attaching said cover frame to said support frame and closing said sheet of transparent material over said vent; and a handle assembly for opening and closing said sheet of material over said vent, said support frame including a pair of elongate support side members being spaced apart, and also including first and second elongate support end members being attached at ends of said elongate support side members, said support frame being attached to said ceiling with adhesive tape, said vent being disposed between said elongate support side members and said first and second elongate support end members.

2. The ceiling vent assembly as described in claim 1, wherein said cover frame includes a pair of elongate support side members being spaced apart, and also includes first and second elongate support end members being attached at ends of said elongate support side members of said cover frame, said hinges being attached to said first elongate support end members of said support frame and said cover frame.

3. The ceiling vent assembly as described in claim 2, wherein said sheet of transparent material is securely attached to and disposed between said elongate support side members and to said first and second elongate support end members of said cover frame.

4. The ceiling vent assembly as described in claim 3, wherein said fasteners include a magnet being attached to said second elongate support end member of said support frame, and also include a piece of metal being attached to said second elongate support end member of said cover frame and being attachable to said magnet to fasten said cover frame to said support frame and to close said sheet of transparent material over said vent.

5. The ceiling vent assembly as described in claim 4, wherein said assembly includes a swivel block having a laterally-disposed groove being disposed in a side thereof, and also includes a spindle being securely disposed in said laterally-extending groove, and further includes an elongate handle member having a first end which is rotatable mounted about said spindle, and also includes a knob being attached at a second end of said elongate handle member.

* * * * *